US005936523A

United States Patent [19]

West

[11] Patent Number: 5,936,523

[45] Date of Patent: Aug. 10, 1999

[54] DEVICE AND METHOD FOR DETECTING UNWANTED DISPOSITION OF THE CONTENTS OF AN ENCLOSURE

[76] Inventor: Joe F. West, 1252 E. Emerald Ave., Mesa, Ariz. 85204

[21] Appl. No.: 09/065,910

[22] Filed: Apr. 24, 1998

[51] Int. Cl.[6] ..... G08B 13/08

[52] U.S. Cl. ..... 340/545.6; 340/572.1; 340/572.8; 340/571; 340/545.2; 340/545.3

[58] Field of Search ..... 340/572, 571, 340/541, 540, 686, 588, 583, 545

[56] References Cited

U.S. PATENT DOCUMENTS

| | | | |
|---|---|---|---|
| 3,683,351 | 8/1972 | Wilcox . | |
| 4,352,097 | 9/1982 | Hamann . | |
| 4,750,197 | 6/1988 | Denekamp et al. . | |
| 4,797,663 | 1/1989 | Rios | 340/691 |
| 4,845,470 | 7/1989 | Boldt, Jr. . | |
| 5,051,725 | 9/1991 | Caccitolo | 340/571 |
| 5,126,719 | 6/1992 | DeSorbo | 340/571 |
| 5,189,396 | 2/1993 | Stobbe | 340/541 |
| 5,231,375 | 7/1993 | Sanders et al. . | |
| 5,323,729 | 6/1994 | Rubey . | |
| 5,406,260 | 4/1995 | Cummings et al. . | |
| 5,481,245 | 1/1996 | Moldavsky | 340/540 |
| 5,515,030 | 5/1996 | Citron et al. | 340/545 |
| 5,528,228 | 6/1996 | Wilk | 340/686 |
| 5,541,578 | 7/1996 | Lussey | 340/571 |
| 5,581,248 | 12/1996 | Spillman, Jr. et al. | 340/870.31 |
| 5,615,247 | 3/1997 | Mills | 379/58 |
| 5,675,319 | 10/1997 | Rivenberg et al. | 340/550 |
| 5,689,243 | 11/1997 | Bianco | 340/825.3 |
| 5,705,981 | 1/1998 | Goldman | 340/541 |
| 5,714,933 | 2/1998 | Le Van Suu . | |
| 5,721,532 | 2/1998 | Lehmann et al. . | |

OTHER PUBLICATIONS

United Dessicants, Humidity Indicators, WWW product brochure, http:/ /www.uniteddesiccants.com/humidity/humidity.htm.

Shockwatch Products, Coldmark Freeze Indicator WWW products brochure, http: / / www.shockwatch.com/products/coldmark.htm.

Shockwatch Products, Heatwatch WWW product brochure http:/ / www. shockwatch.com/products/heatwatch.htm.

Shockwatch Products, Tiltwatch WWW product brochure http:/ /www.shockwatch.com/products/tiltwatch.htm.

Shockwatch Products, WarmMark Time–Temperature Tags WWW product brochure http: / /www.shockwatch.com/products/warmmark.htm.

*Primary Examiner*—Jeffery A. Hofsass
*Assistant Examiner*—Toan N. Pham
*Attorney, Agent, or Firm*—Edwin A. Suominen Squire, Sanders & Dempsey L.L.P.

[57] ABSTRACT

A compact, self-contained device for placing inside a package or other enclosure to detect unwanted disposition of its contents. The device includes a sensor for detecting an environmental condition that indicates unwanted disposition of the contents of the package. The device also includes a compact interface for communicating information about unwanted disposition. Environmental conditions indicative of unwanted disposition include an increase in ambient light to indicate the opening of the package, excessive acceleration from dropping of the package, and excessive heat or cold. The user may arm and interrogate the device by modifying the environmental condition perceived by the sensor. For example, a device using a light detecting sensor may be armed by covering and uncovering with a finger. A device using an acceleration detecting sensor may be armed by tapping on a hard surface. Because it is compact and self-contained, the detecting device can be made to look like a piece of packaging material for concealment.

24 Claims, 8 Drawing Sheets

FIG. 9
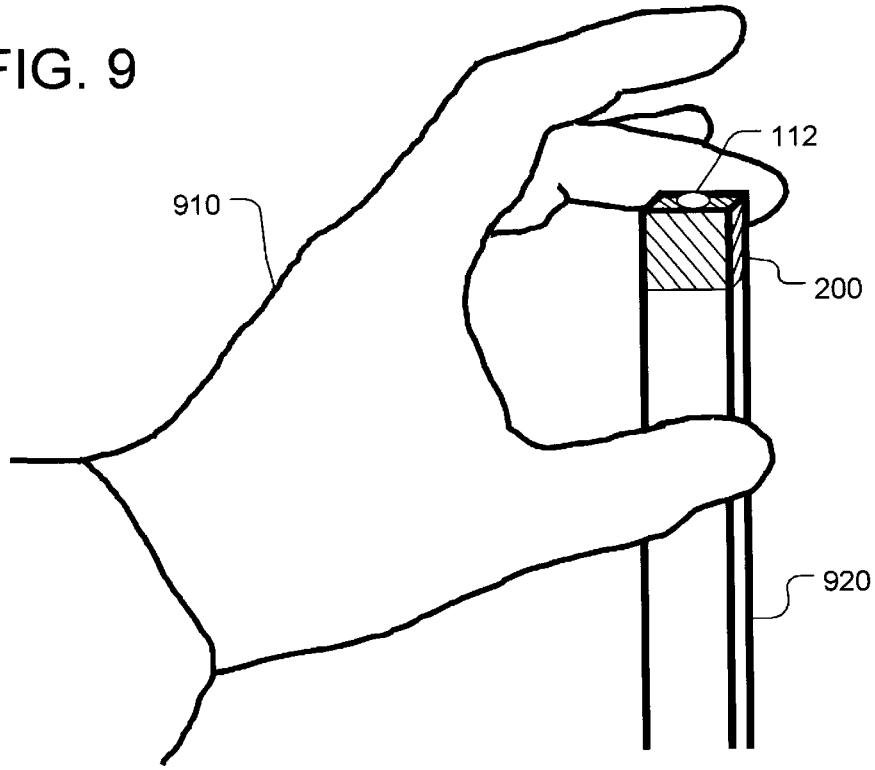
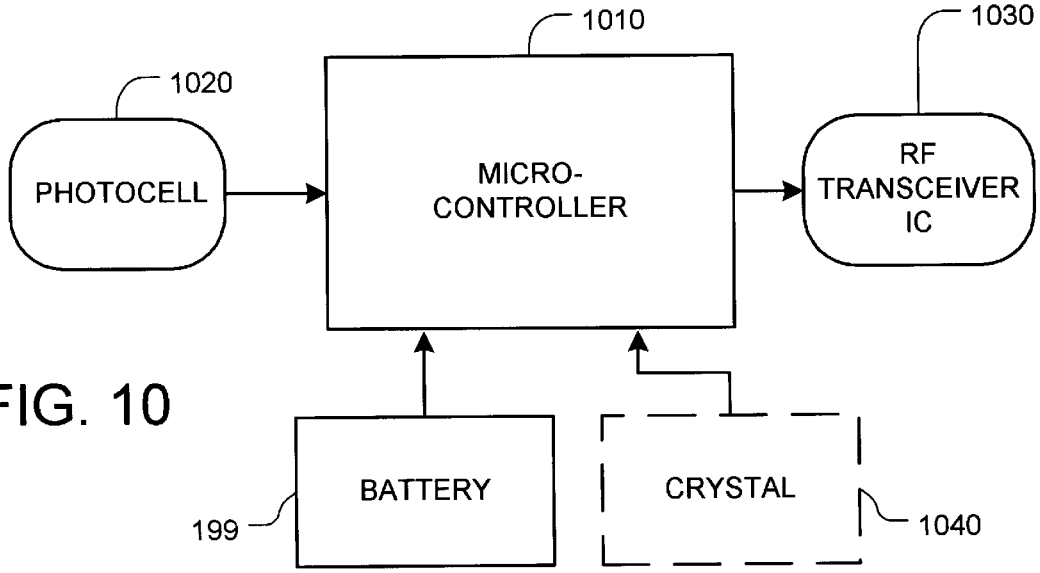
FIG. 10

DEVICE AND METHOD FOR DETECTING UNWANTED DISPOSITION OF THE CONTENTS OF AN ENCLOSURE

FIELD OF THE INVENTION

The present invention relates to the detection of theft, tampering, dropping, or other unwanted disposition of the contents of an enclosure. More particularly, the present invention relates to a compact device capable of detecting, storing, and retrieving information about such unwanted disposition.

BACKGROUND OF THE INVENTION

The contents of an enclosure such as a shipping container or storage locker are often susceptible to theft or damage from mishandling. In many cases, no obvious evidence of the theft or damage can be seen by inspecting the enclosure or its contents. A thief might be sophisticated enough to remove only a small number of valuable items from a package and then reseal it, making it appear that the package was not disturbed. In many cases, the shipper and receiver of such packages are unwilling to make a thorough enough inventory and inspection to detect such pilferage. Many times, the missing valuable items are attributed to a miscount of the product before it was shipped from the manufacturer, leaving the manufacturer to bear the cost of the theft.

Damage from mishandling is also difficult to detect, especially with fragile shipping contents. A package might be dropped off of a loading dock, causing breakage of items that are inside smaller packages. The damage will not be evident until the end user of the fragile product opens the smaller package. At this point, it is more difficult to determine who is responsible for the breakage.

Some products that would be shipped or stored in an enclosure are vulnerable to environmental conditions such as temperature extremes, excessive humidity, and magnetic fields. These products include sensitive electronic devices, magnetic media, and living organisms. When such products are shipped or stored, the environment in which the package containing them has been placed must be controlled. Even if no theft or breakage has occurred, such products can be damaged by remaining too long in a particularly hot or cold area or passing through a magnetic field. There is no way to easily determine if such damage has occurred by inspecting the package.

Electronic devices are described in the patent literature that detect unwanted access to a container by monitoring some sort of physical connection to the container. U.S. Pat. No. 5,189,396, issued to Stobbe on Feb. 23, 1993, for example, calls for a loop of wire or optical fiber to be engaged with the container so that it will be broken if the container is opened. U.S. Pat. No. 5,615,247, issued to Mills on Mar. 15, 1997, describes a pair of cables that are threaded through the door handles of a cargo transport container. These devices detect unwanted access to the container by a disruption of the physical connection to it.

These devices cannot easily be made inconspicuous because they require a physical connection that will be disrupted if the container is opened. The '247 patent teaches away from making the monitoring device inconspicuous by specifying a rotating pattern of lights on the cables. The disclosure of U.S. Pat. No. 4,750,197, issued to Denekamp et al. on Jun. 7, 1988, acknowledges the conspicuousness of an electronic monitoring device using a sensor physically attached to the container. This patent teaches a system including both active and decoy monitoring systems, specifically designed to overcome the fact that each of the monitoring devices is readily apparent to personnel accessing the container.

Applicant has found that a more compact detection device would be desirable because it would not easily be noticed by someone who would tamper with the contents of a shipping or storage enclosure into which it has been placed. A smaller device would be desirable for many other reasons even if concealment were not the objective. A compact detection device would add less to the size and weight of a package in which it is placed for shipping. If the device were used to detect temperature extremes, it could do so faster and more accurately because it would have less thermal mass. A compact device used to measure acceleration or shock would add less mass to the physical system on which it is mounted, and would thus tend not to affect the measurement as much. A smaller device would cost less to manufacture as well.

Compact indicator devices are available that change their physical state to show whether the package to which they are affixed has been subjected to an undesirable environmental condition. These devices undergo some irreversible chemical reaction or mechanical operation when subjected to disposition that could damage the contents of the package to which they are affixed. Such disposition includes excessive humidity, temperature that is too high or too low, angular displacement from vertical, and excessive shock.

These passive devices require specific mechanical or chemical compositions that are especially formulated for the type and severity of the environmental stress to be detected. They are not programmable for specific types and severity of stress. This complicates manufacturing and inventory if a broad range of requirements is to be met. The mechanical deformations and chemical reactions are often not reversible, so the devices must usually be disposed of after use. Cost and limited availability of chemical compositions may be significant as well.

These devices are limited in the amount of information that they can provide about such unwanted disposition because of their simple state-changing mode of operation. A simple pass/fail indicator shows that environmental stress has occurred, but it does not give any more information about the environmental stress. More information is often useful to estimate the extent of damage or to identify the responsible party. If several parties are involved in the shipping of a damaged package, for example, the responsible party cannot be identified without knowing when the damage occurred. Such information could include the severity of the environmental stress as well as the time and date of its occurrence. It might also be useful to know the frequency and duration of stressful events. None of these details can be recorded with a passive state-changing indicator.

Accordingly, it would be advantageous to provide a compact, self-contained device that could detect and record information about unwanted disposition of the contents of an enclosure. It would be desirable for device to record information more detailed than that provided by a passive indicator device in spite of its small size. It would also be desirable for such a device to communicate the information in a format compatible with its compact form.

SUMMARY OF THE INVENTION

The present invention provides a compact, self-contained device that can be placed inside an enclosure to detect unwanted disposition of its contents. The device has a sensor for detecting an environmental condition, which indicates unwanted disposition of the contents of the enclosure in which it is placed. Such environmental conditions include, among others, excessive acceleration from dropping of a package and excessive heat or cold. According to one of several aspects of the invention, the sensor detects an increase in ambient light to indicate the opening of a package in which it has been placed. Due to its self-contained, compact nature, the detecting device provided by the present invention can be easily concealed, costs less to manufacture, and adds little to the size and weight of any container into which it is placed.

In accordance with one aspect of the present invention, a record of the unwanted disposition is provided. This record may be more detailed than that provided by a passive state-changing indicator without a significant increase in size and cost from such an indicator.

In accordance with another aspect of the present invention, a compact interface format compatible with a compact, self-contained device is used for receiving user commands and communicating the record of unwanted disposition.

In accordance with another aspect of the invention, the opening of a package is detected from an entirely self-contained, inconspicuous device that can be placed inside the package without any physical connection to it.

According to yet another aspect of the invention, a detailed record of unwanted disposition may be provided. This is advantageous in that a party responsible for the unwanted disposition may be identified through a record of the time and date of unwanted disposition. Damage may also be estimated through a record showing the severity of the environmental stress, as well as the frequency and duration of stressful events.

According to still another aspect of the invention, a user interface for arming, retrieval of data, or both arming and retrieval may be provided with the same sensor used for detecting the unwanted disposition. The user simply modifies the environmental condition perceived by the environmental sensor in a time-related pattern. In an embodiment according to this particular aspect of the invention, the sensor detects changes in the level of ambient light and the user covers the light sensor in a repeating sequence to enter the appropriate arming or interrogation command. In another embodiment of the invention, the sensor detects high levels of acceleration and the user taps the device containing the sensor in a repeating sequence to enter the appropriate arming or interrogation command. By using the sensor for responding to user input, this aspect of the invention helps to achieve compactness.

Additional aspects, advantages, and novel features of the invention will become apparent to those of skill in the art from the detailed description of the preferred embodiments which follows, and from practice of the invention itself.

BRIEF DESCRIPTION OF THE DRAWINGS

The present invention will hereinafter be described in conjunction with the figures of the appended drawing, wherein like designations denote like elements, and:

FIG. 9 shows an embodiment of the invention using a light detecting sensor, constructed to have the appearance of an IC tube stopper, and a technique for sending user input using the sensor.

FIG. 10 is a block diagram showing electronic components used in a preferred embodiment of the invention.

DETAILED DESCRIPTION OF PREFERRED EXEMPLARY EMBODIMENTS

Figure 1:
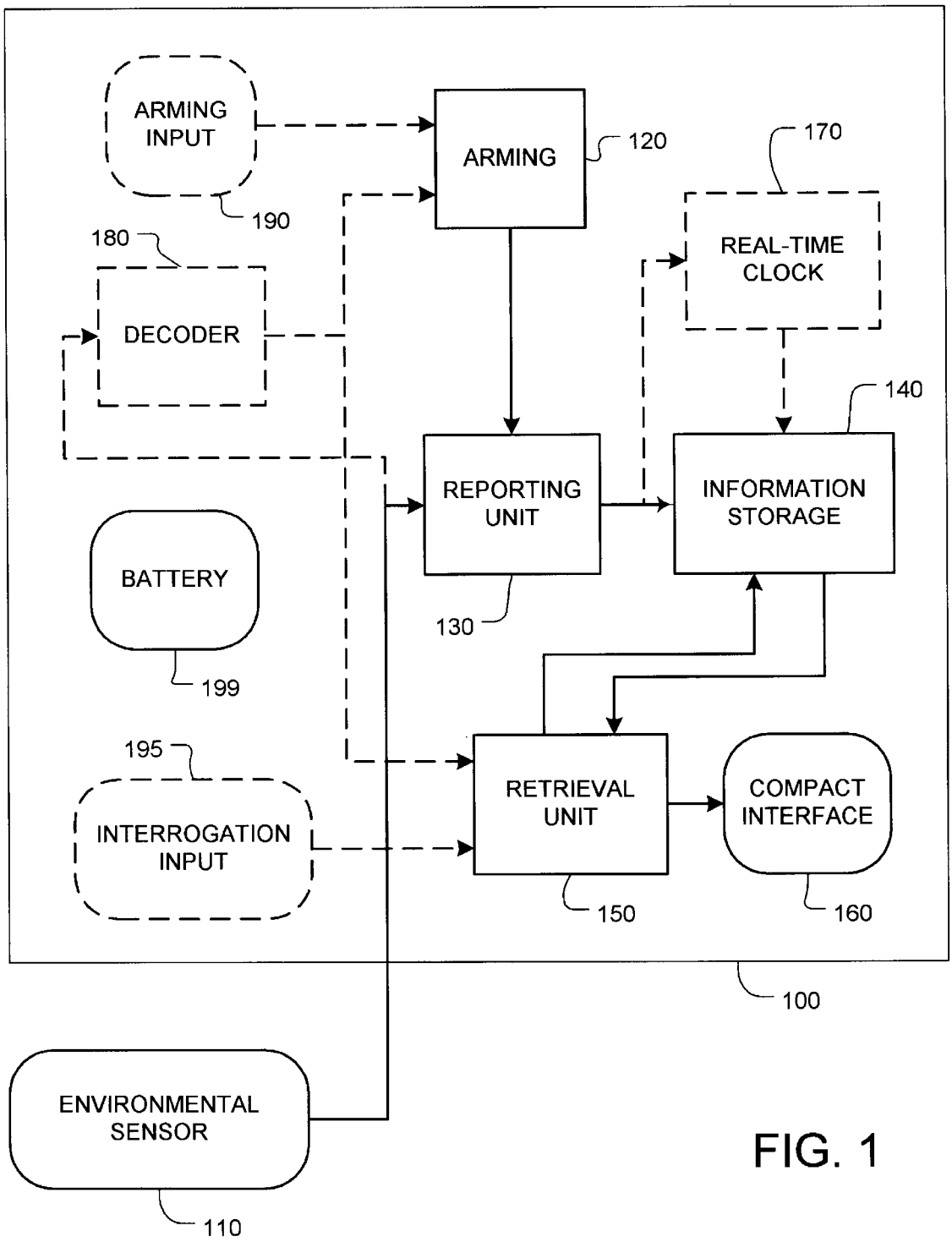
FIG. 1 is an overall block diagram showing the general configuration of a device according to the present invention.

Referring to FIG. 1, a compact device for placing in an enclosure and detecting unwanted disposition of its contents includes an environmental sensor 110 for providing a signal indicative of unwanted disposition and a detector 100 for responding to the signal. The signal is transmitted to a reporting unit 130 in detector 100, which is enabled by an arming unit 120, for providing information about unwanted disposition. The information is recorded by an information storage unit 140. The record from information storage unit 140 is retrieved with a retrieval unit 150 and communicated to the user via a compact interface 160. A record of the time of unwanted disposition may be provided to information storage unit 140 by a real-time clock 170. A battery 199 serves as a self-contained power source to provide electrical power to detector 100, as well as any power required by environmental sensor 110.

Most of the functional blocks shown inside detector 100 are preferably implemented as software functions executed by a single microcontroller, as will be discussed below with respect to FIG. 10. Environmental sensor 110 and detector 100 are located in the same compact device and form a single unit. They are shown as separate entities solely to illustrate the interchangeability of different types of environmental sensors in the several embodiments of the present invention that are described below with respect to FIGS. 2–6.

In the description and claims that follow, the term "enclosure" is intended to encompass any portion of space surrounded by a protecting or containing surface in which items are placed whose unwanted disposition is to be monitored. The term naturally applies to shipping and storage containers, but also is intended to include such enclosures as desks drawers or cabinets. Unwanted disposition can be theft or tampering of items in an enclosure such as a package. An exemplary embodiment of the present invention will be described that detects the unwanted disposition of theft or tampering of a package's contents by sensing additional light from opening of the package. However, it is to be understood that the term "unwanted disposition" encompasses any environmental condition or act that is detrimental to the contents of the enclosure. Other examples of unwanted disposition include dropping of a package, exposure to excessive heat or cold, placing a package upside down, and exposing a package containing magnetic media to magnetic fields.

Referring again to FIG. 1, an arming command is sent to arming unit 120 by a user to activate reporting unit 130 for detection of unwanted disposition. An interrogation command is sent to retrieval unit 150 for retrieving a record of the unwanted disposition from information storage unit 140. In an exemplary embodiment of the invention, these two commands are sent by the user using the same environmental sensor 110 that is used to detect unwanted disposition. Thus, no additional input devices are needed for user control of the device. This allows an extremely compact device to be constructed.

In this exemplary configuration, user input is applied to environmental sensor 110 through a time-related pattern of user modification of the environmental condition it is designed to detect. The output of sensor 110 is then applied to a decoder 180, which extracts the user information from the time-related pattern. If no valid time-related pattern is detected by decoder 180, no arming or interrogation command will be sent to arming unit 120 or retrieval unit 150. If, however, a time-related pattern of changing environmental condition is detected by sensor 110 and decoder by decoder 180 as being either an arming command or interrogation command, the appropriate command will be set to arming unit 120 or retrieval unit 150. Of course, the time-related patterns will be different and distinct for arming and interrogation commands.

There may be more than one type of arming or interrogation command for different modes of operation. For example, the device may be armed to operate in either an absolute time mode, reporting the date and/or time of unwanted disposition, or in a differential time mode, reporting the amount of time that passed between arming of the device and the unwanted disposition. In addition, a separate arming command may be used to erase or preserve the record of unwanted disposition currently stored in information storage unit 140.

The use of environmental sensor 110 for user input provides significant advantages over an embodiment with a separate input interface. However, an optional arming input 190 may still be provided along with an optional interrogation input 195. If separate inputs are used for controlling arming unit 120 and retrieval unit 150, the encoding of their respective user commands may be simplified somewhat. For example, it may be sufficient to arm the device by simply pressing a small push button or membrane switch used for arming input 190. Of course, a single input may be used with encoding for asserting both the arming and interrogation commands. Decoder 180 could be connected to the common input, rather than environmental sensor 110, to differentiate the arming and interrogation commands and activate either arming unit 120 or retrieval unit 150, as appropriate.

Environmental sensor 110 generates a signal that is proportional in amplitude to a particular type of environmental condition. As will be discussed with respect to FIG. 2, sensor 110 may be a photocell that generates a signal proportional to the level of light reaching it. Alternatively, sensor 110 may be a thermistor used with a circuit to generate a signal was amplitude is proportional to temperature. An embodiment using such a circuit will be described with respect to FIG. 3. As yet another alternative, sensor 110 may be an accelerometer that generates the signal proportional to the amount of acceleration to which it is subjected. An embodiment using an accelerometer will be discussed with respect to FIG. 4. Many other embodiments are of course possible, several of which will be discussed with respect to FIGS. 5 and 6.

When reporting unit 130 has been enabled by arming unit 120 through the arming command, it becomes responsive to the signal from environmental sensor 110. When the signal from sensor 110 passes a certain threshold, reporting unit 130 reports an unwanted disposition to information storage unit 140. Reporting unit 130 may have a glitch rejection capability for differentiating between merely transitory noise or glitch signals from environmental sensor 110 and genuine indication of unwanted disposition. Reporting unit 130 may also activate real-time clock 170, which in turn sends information about the date and/or time of the unwanted disposition to storage unit 140. Real-time clock 170 may operate in either an absolute time mode, reporting the date and/or time of unwanted disposition, or in a differential time mode, reporting the amount of time that passed between arming of the device and the unwanted disposition. Arming unit 120 may control the mode of real-time clock 170, depending on a particular type of arming command sent by the user. The report of unwanted disposition from reporting unit 130 may include information about the magnitude of environmental stress and duration of its occurrence, as well as the date and/or time of its occurrence. If multiple records of unwanted disposition are stored in storage unit 140, the frequency of unwanted dispositions within a given time frame may also be determined. The times of the first and last records of continuous unwanted disposition may be used to compute the duration of environmental stress. If the interval at which multiple records are reported from reporting unit 130 is fixed, the duration of environmental stress may also be computed from the number of sequential records in information storage unit 140.

Retrieval unit 150 accesses the record of information storage unit 140 and sends that information to compact interface 160 for transmission to the user. Compact interface 160 transmits this information in a format that is compatible with a compact device. It may be desirable to use a compact wireless transmitter to communicate this information to the user, as will be discussed with respect to FIGS. 2 and 4. Although the information provided by retrieval unit 150 is more detailed than the sample "stressed/not stressed" indication given by a conventional passive indicator device, it may still be limited enough in scope to be transmitted directly to the user with a simple display format. Embodiments using an LCD readout and audio transducer will be described with reference to FIGS. 3 and 5, respectively.

Figure 2:
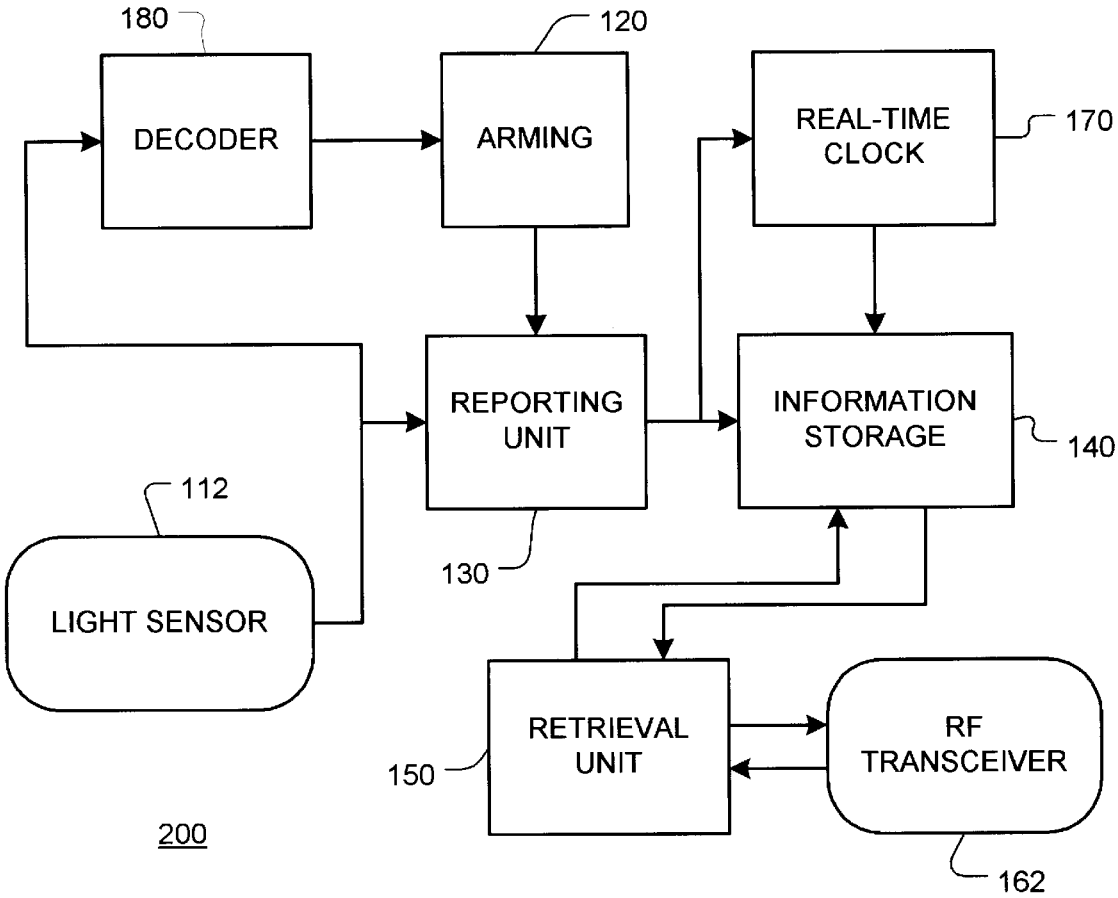
FIG. 2 is a block diagram showing an embodiment of the invention using a light sensor to detect an increase in ambient light and to accept an arming command, and using a room and wireless transceiver to accept an interrogation command and communicate the record of unwanted disposition.

Referring now to FIG. 2, an exemplary embodiment 200 of the present invention will now be described in detail. This embodiment detects opening of the package in which is placed by sensing additional light entering the package as it is opened. A light sensor 112 performs the role of environmental sensor 110 of FIG. 1. Light sensor 112 comprises a solid-state optical sensing component such as the HI-T520 phototransistor manufactured by Hitachi. The phototransistor is mounted in the inventive device so that ambient light will fall on its semiconductor material. The phototransistor is used as part of a conventional amplifier circuit to produce an electrical signal whose amplitude is proportional to the amount of light falling on the inventive device.

The output of light sensor 112 is sent to reporting unit 130 and decoder 180. Decoder 180 waits for a particular pattern of output signals from photocell 112. FIG. 9 shows how the user asserts the arming command by blocking and unblocking the ambient light from light sensor 112 with a finger 910. The preferred sequence is for the blocking and unblocking to be repeated three times in two seconds, but other sequences may of course be used. When decoder 180 of FIG. 2 determines that the output signal from light sensor 112 has undergone significant deviation three times in a two second period, it activates reporting unit 130 through arming unit 120. Arming unit 120 waits a set amount of time before activating reporting unit 130. This allows the user to complete packaging before the device begins detecting an increased amount of ambient light from that which would be found inside a sealed package. Once activated, reporting unit 130 monitors the signal from light sensor 112 for evidence of increased ambient light that indicates opening of the package.

Reporting unit 130 compares the signal from light sensor 112 to a threshold value. This threshold value is selected to be greater than the signal produced from the light that reaches the inside of the package. The threshold value should not be made too large, however, because the package may be opened in a darkly lit area. One of skill in the art will recognize that reporting unit 130 may be configured to respond to more than just a threshold value. A gradually increasing amount of light will enter the package as it is opened, and reporting unit 130 may be configured to recognize this time-related increase in the amplitude of the signal from light sensor 112. With such a configuration, an exact threshold value is less important than the characteristic increase in amplitude associated with an opening of the package.

Once it has detected that the package has been opened, reporting unit 130 requests the current time information from real-time clock 170 and creates a record that is stored in information storage unit 140. Preferably, this record includes the amount of light detected upon opening as well as the time and date of opening. It is useful to know the amount of light that entered the package when it was opened because this can provide clues about where the unauthorized opening took place. If light sensor 112 includes chromatic sensors that can provide information about the spectral content of the light, this spectral information may be reported by reporting unit 130 as well. This spectral information may provide evidence of where the unauthorized opening took place by comparing the recorded spectral information with the spectral content of the light available at each suspected location.

Information storage unit 140 stores the record in a preferably non-volatile memory, although battery 199 shown in FIG. 1 provides a self-contained power source so that a volatile memory may also be used. Non-volatile memory is more reliable because the record from information storage unit 140 could be retrieved even if battery 199 shown in FIG. 1 has lost power and needed to be replaced.

Referring again to FIG. 2, a user wishing to review the record from information storage unit 140 sends the interrogation command to retrieval unit 150 through a compact RF transceiver 162, which performs the function of compact interface 160 of FIG. 1. Retrieval unit 150 then obtains the record from information storage unit 140 and transmits it to the user through RF transceiver 162. The use of an RF transceiver allows the information in storage unit 140 to be accessed without even opening the package in which the inventive device has been placed. A shipment of many packages, each having a device constructed according to the invention, could be inspected quickly and automatically by polling each device with an interrogation command through RF transceiver 162.

RF transceiver 162 contains, in this exemplary embodiment, a single-conversion frequency-shift-keying (FSK) receiver. In transmit mode, the local oscillator for the receiver is FSK modulated to provide a transmitted signal. RF transceiver 162 is normally in receive-only mode, awaiting an interrogation command from the user. RF is transmitted only in response to the interrogation command, so the transceiver architecture may be half-duplex and thus greatly simplified. To preserve life of battery 199 shown in FIG. 1 and possibly allow unlicensed operation, the RF transmitter operates at a very low power level. One of skill in the art will recognize that the present invention may be practiced using many possible modulation formats and configurations for RF transceiver 162. Indeed, the receiver architecture used for RF identification tags may be easily adapted for the purposes of the invention. A suitable device is the DTR-900 miniature Data Transceiver manufactured by the Radio Design Group Inc. If a custom transceiver is to be built, it could be centered around a UAA2080 receiver IC and a UAA2081 FSK transmitter IC, both manufactured by Philips.

Preferably, a single microcontroller performs the functions of decoder 180, arming unit 120, reporting unit 130, information storage unit 140, retrieval unit 150, and real-time clock 170. Some of these functions may be performed by distinct blocks of circuitry within the microcontroller, while some functions may be performed as different sections of code executed by the microcontroller. A more specific description of the microcontroller configuration will be given with respect to FIG. 9.

Those of skill in the art will recognize that there are many different types of environmental sensing devices and compact interface formats which may be used in numerous combinations to provide a compact device for placing in an enclosure and detecting unwanted disposition of its contents, in accordance with the present invention. By way of example, several such combinations forming other embodiments of the invention will now be described, beginning with respect to FIG. 3. The purpose of these examples is not to limit the present invention to what is disclosed, but rather to provide a fuller description of the breadth of the present invention in encompassing many different combinations of environmental sensing devices and compact interface formats.

Figure 3:
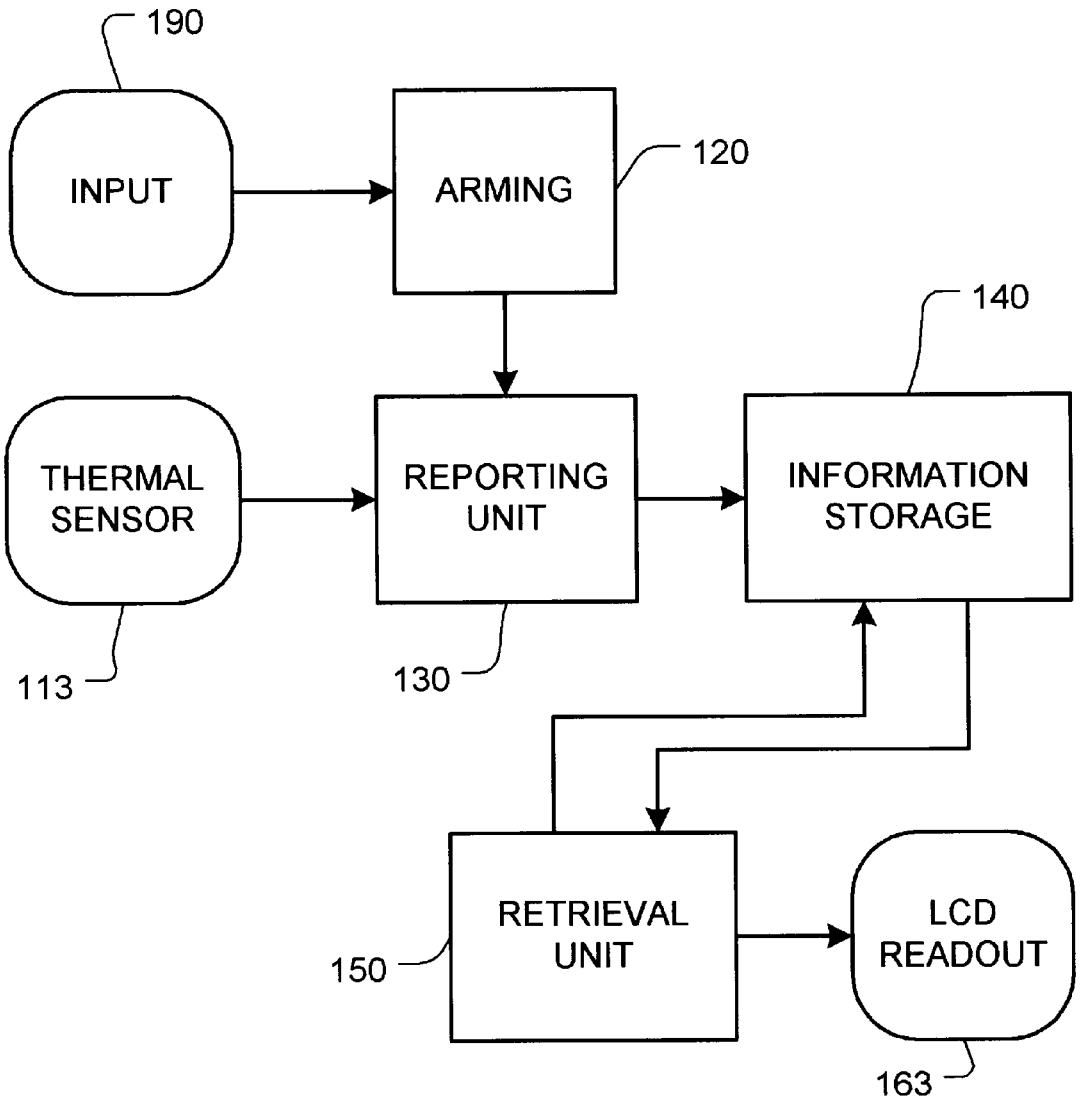
FIG. 3 is a block diagram showing an embodiment of the invention using a thermal sensor to detect an increase in temperature and to accept an arming command, and using an LCD display to communicate the record of unwanted disposition without any interrogation command.

The embodiment shown in FIG. 3 is configured to provide information about the severity of temperature stress to the contents of the package in which is placed. In this example, the only data transmitted to the user is the maximum temperature encountered and the duration of time in which temperatures above a certain maximum threshold were encountered. Although it can be very important for certain uses of the invention, this information is limited in scope. Thus, it can be transmitted continuously without the need for an interrogation command.

Referring to FIG. 3, a thermal sensor 113 performs the role of environmental sensor 110 of FIG. 1. Thermal sensor 113 comprises a thermistor such as those manufactured by Sensor Scientific, Inc. The thermistor is mounted in the inventive device so that its temperature will quickly reach that of the ambient temperature. The thermistor is used as part of a conventional amplifier circuit to produce an electrical signal whose amplitude is proportional to the temperature of the inventive device.

The output of thermal sensor 113 is sent to reporting unit 130. In this embodiment, the user asserts the arming command with arming input 190 of FIG. 1. After receiving the arming command from arming input 190, arming unit 120 may wait a set amount of time before activating reporting unit 130. This allows the user to complete packaging before the device begins detecting temperatures that would not be acceptable for shipping. This might be important if the contents must be refrigerated, and the device is armed at room temperature. In this case, it would be desirable for arming unit 120 to activate reporting unit 130 only after the package has had time to be refrigerated. Once activated, reporting unit 130 monitors the signal from temperature sensor 113 for evidence of excessive temperature.

Reporting unit 130 compares the signal from temperature sensor 113 to a threshold value. This threshold value is selected to coincide with the signal amplitude from thermal sensor 113 at the highest limit of acceptable temperature. Once it has detected that the device has encountered excessive temperature, reporting unit 130 creates a record that is stored in information storage unit 140. In this example, this record simply consists of the maximum temperature encountered and the duration of time during which excessive temperatures were encountered. This information may be useful, for example, in determining whether valuable biological samples have been damaged in transit by a transitory failure of refrigeration. If the failure were only momentary, no damage may have been incurred.

In the embodiment of FIG. 3, the information contained in information storage unit 140 is relatively limited in scope. Thus, it may be transmitted to the user continuously in a compact interface format. In this example, retrieval unit 150 continuously retrieves this information from information storage unit 140 without the need for an interrogation command. The information is sent to a compact LCD readout 163, which performs the function of compact interface 160 of FIG. 1. A tiny four-digit readout, much smaller than a wristwatch face, is used to alternately display the maximum temperature encountered and the total number of minutes in which excessive temperatures were encountered. In this example, it is assumed that there would be no need to know the total duration of excessive temperature beyond 999.9 minutes because the maximum possible amount of damage would have been sustained within that time. A small indicator on the LCD readout that alternately displays "Temp" and "Time" allows the user to interpret the alternating display as showing maximum temperature or duration of excessive temperature.

Figure 7:
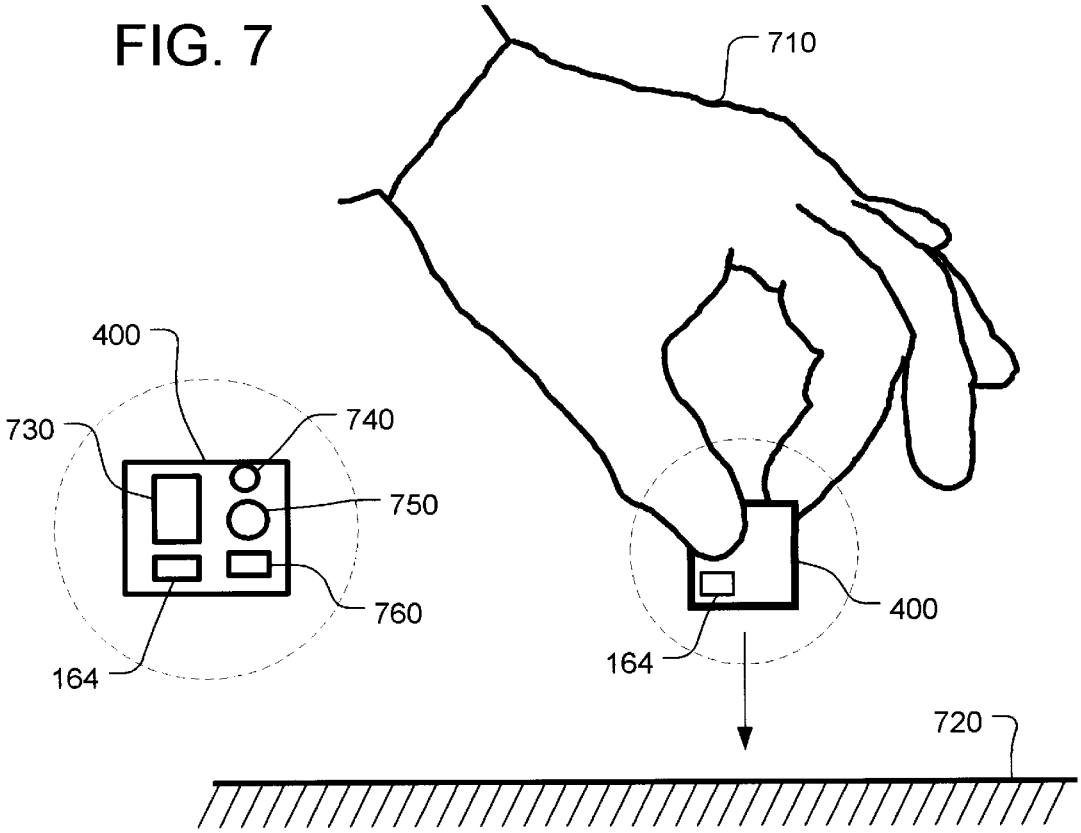
FIG. 7 shows an embodiment of the invention using an accelerometer sensor and a technique for sending user input using the sensor.

FIG. 7 shows a compact device 400 constructed in accordance with the invention that detects excessive acceleration. This embodiment of the invention uses an acceleration sensor for both detection of unwanted disposition and user input of the arming and interrogation commands. The user takes device 400 in one hand 710 and taps it on a hard surface 720 three times in succession to enter the arming command. After three taps, the microcontroller detects the arming sequence and issues the arm delay enable signal to signify the start of the arming delay sequence. To retrieve information from device 400, the user enters the interrogation command by tapping device 400 on hard surface 720 five times in succession.

Device 400 preferably contains a printed wiring board, which will oscillate at a fundamental frequency when device 400 is tapped on hard surface 720. This oscillation damps out quickly due to the filtering effect of hand 710 holding the device. Thus, three or five distinct taps for the arming and interrogation commands, respectively, will be detectable by decoder 180, shown in FIG. 4, if a reasonable delay is present between taps. Decoder 180 may include some simple analog or digital lowpass filtering to reject the higher frequency oscillation inside device 400 while still preserving the lower frequency acceleration spikes from tapping device 400 on hard surface 720.

Figure 8A:
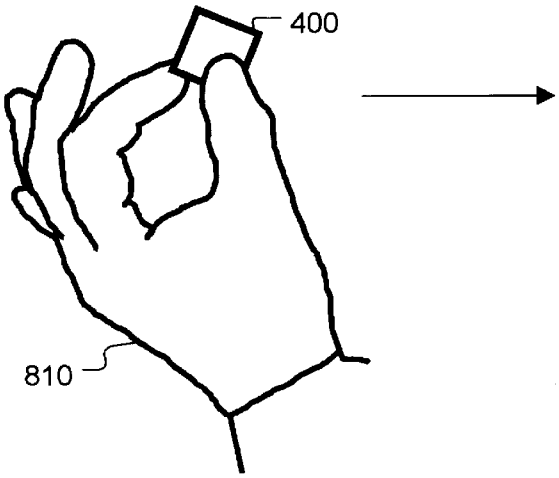
FIGS. 8*a* & 8*b* show an embodiment of the invention using a tilt-detecting sensor and a technique for sending user input using the sensor.
Figure 8B:
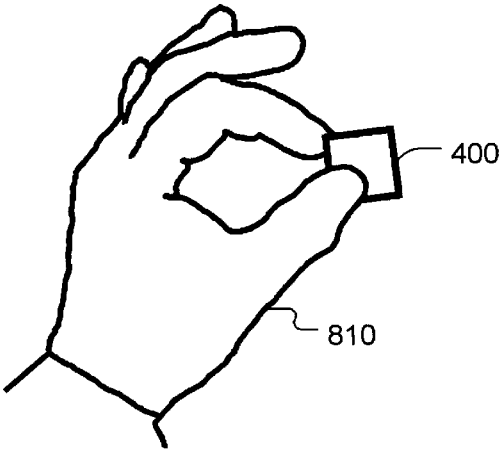

FIG. 8 shows how the user arms the device 800 that is similar to device 400 of FIG. 7. The difference between device 800 and device 400 is that device 800 detects off-axis acceleration rather than the magnitude of acceleration detected by device 400. Stated simply, device 800 is a tilt detector for packages that must remain upright during shipment. To arm device 800, the user takes it in one hand 810, tilted backward as shown in FIG. 8*a,* and sharply tilts the device forward as shown in FIG. 8*b.* The user enters the arming command by repeating this tilting three times in succession. To retrieve information from device 800, the user enters the interrogation command by tilting device 800 five times in succession.

Figure 4:
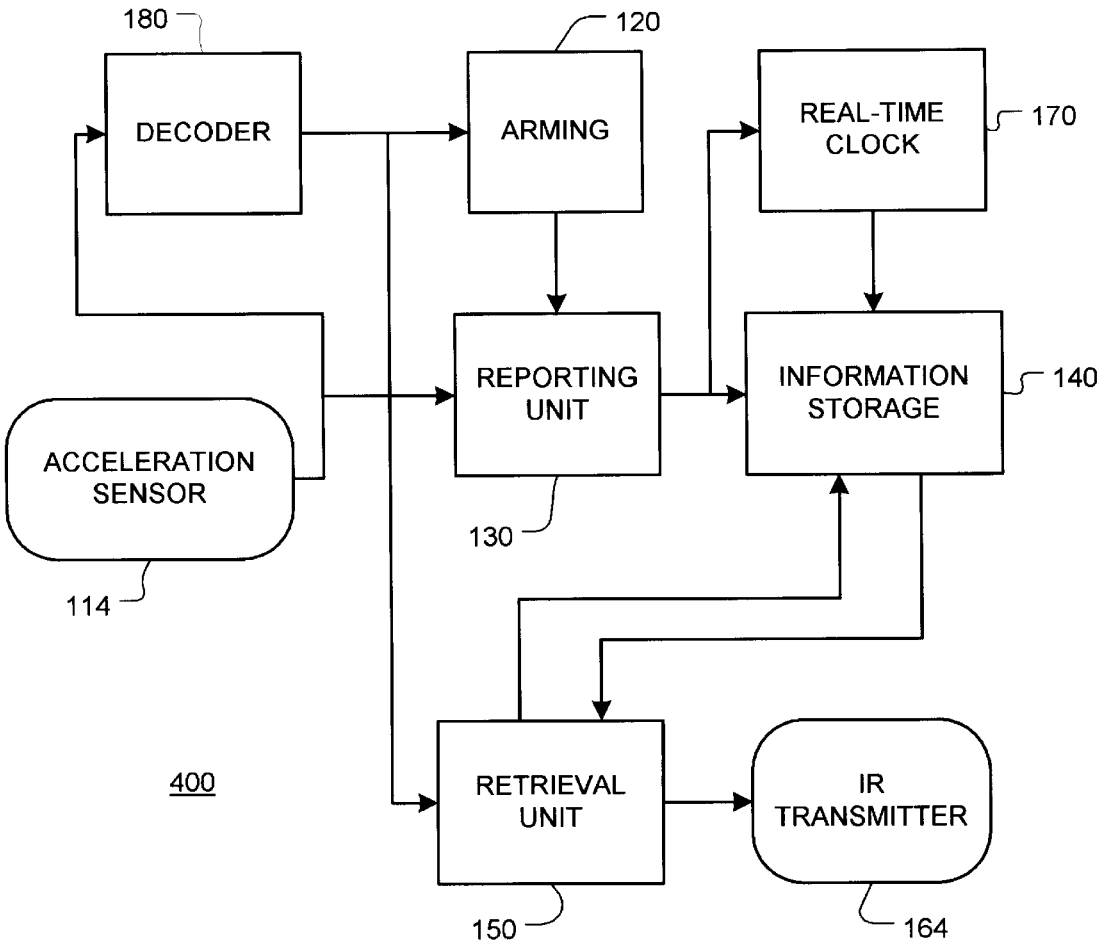
FIG. 4 is a block diagram showing an embodiment of the invention using an acceleration sensor to detect mishandling of a package, a dedicated input to accept arming and interrogation commands, and an infrared transmitter to communicate the record of unwanted disposition.

Referring now to FIG. 4 for a further description of device 400, an acceleration sensor 114 performs the role of environmental sensor 110 of FIG. 1. Acceleration sensor 114 comprises, in this example, an EGA series miniature accelerometer manufactured by the Entran® Company. The accelerometer is used as part of a conventional amplifier circuit to produce an electrical signal whose amplitude is proportional to the acceleration to which the inventive device is subjected.

The output of acceleration sensor 114 is sent to reporting unit 130 and decoder 180. Decoder 180 waits for a particular pattern of output signals from acceleration sensor 114. In the preferred embodiment, the user asserts the arming command by tapping device 400 on a hard surface three times in two seconds, as described previously with respect to FIG. 7. Other sequences may of course be used as well. When decoder 180 determines that the output signal from acceleration sensor 114 has undergone significant deviation three times in a two second period, it activates reporting unit 130 through arming unit 120. Arming unit 120 waits a set amount of time before activating reporting unit 130. This allows the user to complete packaging before the device begins detecting excessive accelerations. The acceleration forces encountered in handling a device as compact as device 400 may be significantly higher than what would be acceptable for a large package in which device 400 might be placed. Accordingly, it may be desirable to delay the activation of device 400 so that it detects such acceleration only after it has been packaged up. Once activated, reporting unit 130 monitors the signal from acceleration sensor 114 for evidence of excessive acceleration from mishandling.

Reporting unit 130 compares the signal from acceleration sensor 114 to a threshold value. This threshold value is selected to be greater than the signal produced from normal acceleration encountered with reasonable handling of the package. Once it has detected that the package has been mishandled, reporting unit 130 requests the current time information from real-time clock 170 and creates a record that is stored in information storage unit 140. This record will show the magnitude of acceleration and when the acceleration occurred, and may also include the shock spectrum to provide information about the nature of the shock. This information may help to determine whether the mishandling was of an accidental or malicious nature.

Information storage unit 140 stores the record in a preferably non-volatile memory. A user wishing to review this record sends the interrogation command through acceleration sensor 114 in the manner described above with respect to FIG. 7. Retrieval unit 150 then obtains the record from if storage unit 140 and transmits it to the user through an infrared transmitter 164 using an infrared light-emitting-diode (LED), which performs the function of compact interface 160 of FIG. 1. The record is transmitted to the user in digital format through on/off keyed infrared radiation. Of course, the user will need to use an infrared receiver to demodulate and decode the on/off keyed infrared signal. The design of both infrared transmitter 164 and a corresponding infrared receiver is well within the capabilities of one skilled in the art, as evidenced by the millions of infrared remote control units presently available for television receivers at very modest cost.

Referring again briefly to FIG. 7, the LED for infrared transmitter 164 is mounted so that its output will be visible outside of device 400. A possible arrangement of electronic devices in device 400 is shown. These devices include an accelerometer 750, which is the active element for acceleration sensor 114, a microcontroller 730, a compact battery 740, and a crystal 760 for controlling the oscillator inside microcontroller 730. The compactness of device 400 becomes evident by comparison to hand 710 of the user.

Figure 5:
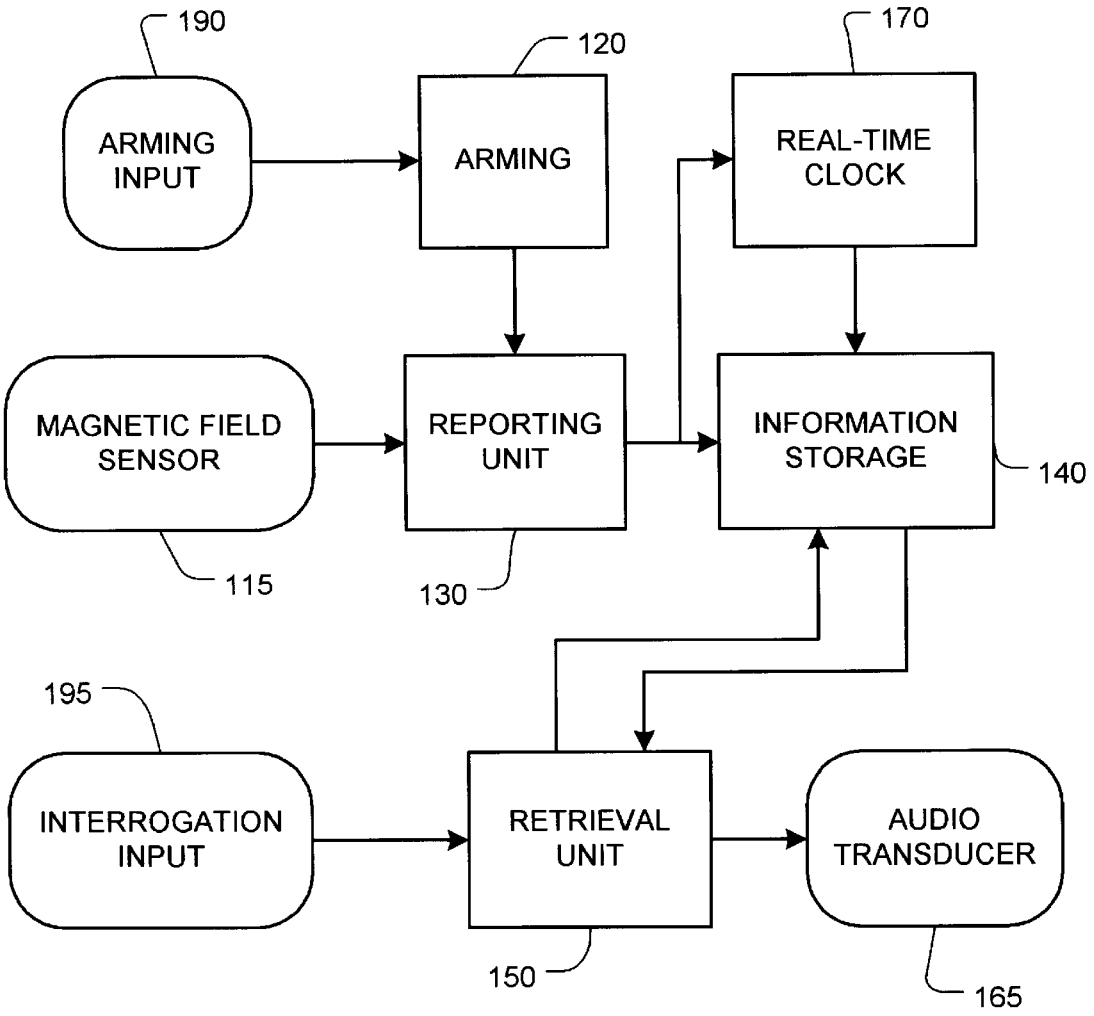
FIG. 5 is a block diagram showing an embodiment of the invention using a magnetic field sensor to detect harmful magnetic fields, separate dedicated inputs to accept respective arming and interrogation commands, and an audible transducer to communicate the record of unwanted disposition.

Referring now to FIG. 5, an embodiment is described using a magnetic field sensor 115 to perform the role of environmental sensor 110 of FIG. 1. Magnetic field sensor 115 comprises a Hall-effect device, such as the Monolithic Integrated Magnetic Field and Current Sensor available from Fraunhofer Institute in Germany. The Hall-effect device is mounted so that it detects any magnetic flux impinging on the inventive device. The Hall-effect device is used as part of a conventional amplifier circuit to produce an electrical signal whose amplitude is proportional to the strength of the magnetic field.

In the embodiment of FIG. 5, a separate arming input 190 and interrogation input 195 are used to send the arming command to arming unit 120 and interrogation command to retrieval unit 150, respectively. Arming unit 120 responds to the arming command from arming input 190 by activating reporting unit 130. Reporting unit 130 compares the signal from magnetic field sensor 115 to a threshold value. This threshold value is selected to coincide with the signal amplitude from magnetic field sensor 115 at the highest acceptable level of magnetic flux. This threshold may be set just below the lowest level of flux at which erasure of magnetic media would begin.

Once it has detected that the package has been subjected to excessive magnetic flux, reporting unit 130 requests current time information from real-time clock 170 and creates a record that is stored in information storage unit 140. This record will show when damaging levels of magnetic flux were encountered.

Information storage unit 140 stores the record in a preferably non-volatile memory. A user wishing to review this record sends the interrogation command through interrogation input 195. Retrieval unit 150 then obtains the record from information storage unit 140 and transmits it to the user through an audio transducer 165, which performs the function of compact interface 160 of FIG. 1. The record is preferably transmitted to the user through audio transducer 165 in the form of synthesized speech, although less sophisticated schemes such as Morse code could also be used.

While several embodiments of the present invention have been described with reference to FIGS. 2–5, those of skill in the art will recognize that many additional types of environmental sensing devices may be used in accordance with the present invention. Three of these are briefly described now with respect to FIG. 6. The elements in detector 100 are shown in greater detail in FIG. 1.

Figure 6:
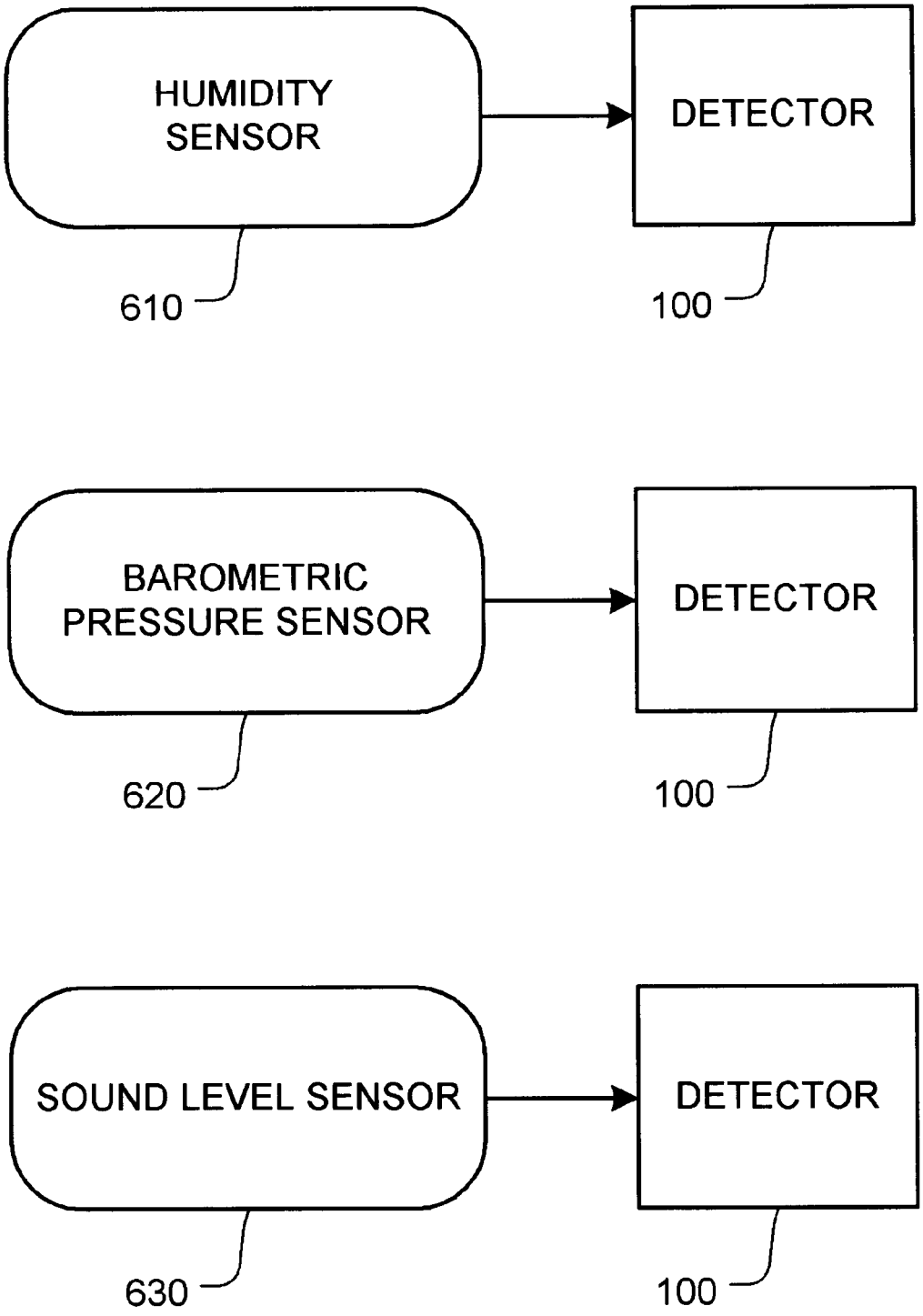
FIG. 6, comprising FIGS. 6(*a*)–6(*d*), shows embodiments of the invention using sensors that detect humidity, barometric pressure, and sound level.

FIG. 6(*a*) shows an embodiment of the invention using a humidity sensor 610 to perform the role of environmental sensor 110 of FIG. 1. This embodiment is configured to detect humidity outside acceptable limits, record the duration of those conditions, and report the results. A suitable humidity sensor is the UPS series of resistive relative humidity sensors manufactured by Ohmic Instruments.

The humidity sensor is biased via a supply voltage and returns a somewhat linear output voltage as a function of relative humidity. A high or low threshold is set so that the input to the microcontroller is triggered at an appropriate humidity level. The threshold is preferably adjustable with a variable resistor to meet the needs of the user.

FIG. 6(*b*) shows an embodiment of the invention using a pressure sensor 620 to perform the role of environmental sensor 110 of FIG. 1. This embodiment of the invention is configured to detect barometric pressure outside acceptable limits, record the duration of those conditions and report the results. A suitable pressure sensor is the EPL surface mount miniature pressure transducer, manufactured by Entran®.

The pressure sensor is biased via a DC supply voltage and returns a current that varies as a function of absolute or gauge pressure, depending on the type of transducer used. The current is converted to a voltage via a resistor, which is then voltage divided down to provide the required threshold pressure setting.

FIG. 6(*c*) shows an embodiment of the invention using a sound level sensor 630 to perform the role of environmental sensor 110 of FIG. 1. Sound level sensor 630 comprises a microphone whose input may be filtered to provide the proper frequency response in a given bandwidth. In one configuration, the sound level detected is filtered and compared to a fixed threshold, which is set to the acoustic levels determined to be damaging.

Because of its compact, self-contained nature, the present invention is useful for providing a concealed detection device. In such an embodiment, the device is concealed in a surrounding shell of packaging material so that it is not easily detected when placed in a package. Suitable packaging materials for concealing the device include, for example, a foam packing "peanut", a desiccant bag of the type commonly shipped with integrated circuits to minimize humidity, and an inner packaging box which is to be placed inside an outer package.

The surrounding shell of packaging material may actually form an enclosure for the other components used. In such an embodiment of the invention, the surrounding shell of packaging material becomes part of the device. By way of example, FIG. 9 shows an embodiment of the invention that is a device 200 constructed to look like a stopper of a tube 920 of integrated circuits (ICs). Tube 920 is an industry-standard integrated circuit packaging tube, usually constructed of an anti-static material, which is packed with ICs lined up end to end. These packaging tubes always have some sort of removable stopper in each end to prevent the ICs from falling out the lower end of the tube. Device 200 is constructed to look like a normal tube stopper to the casual observer. A small aperture in the end of device 200 conceals light sensor 112 while still allowing it to sense ambient light around tube 920 and its modified stopper, device 200. As discussed above, the user arms device 200 by tapping finger 910 over light sensor 112 in a repeated sequence. The additional use of light sensor 112 to accept user input makes a significant contribution to the compactness of device 200.

The type of packaging material used as a surrounding shell for concealment is selected in accordance with the type of environmental sensor used. In the example of FIG. 9, an aperture is provided to allow light to reach light sensor 112. An embodiment of the invention using a light sensor may also be surrounded by a desiccant bag because the material used in such a bag is translucent. A light sensor in a device that is concealed in this fashion will produce a signal with somewhat lower amplitude, however, because light reaches it after passing through the surrounding shell of the bag and desiccant. Similarly, a device using an accelerometer that is concealed in a desiccant bag experiences less forceful acceleration peaks because the surrounding material has a cushioning effect. This will change the signal threshold that should be used for detecting unwanted disposition, but the correct threshold may be easily determined for any suitable type of packaging material used as a surrounding shell.

Referring now to FIG. 10, an arrangement of electronic components includes a microcontroller 1010, preferably a PIC12CE519 microcontroller manufactured by Microchip Inc. The PIC12CE519 is presently available in a very small surface-mount package, and lends itself to use in a compact device. The PIC12CE519 has an internal oscillator, so no external crystal is needed. However, an internal oscillator in microcontroller 1010 may be controlled by a crystal 1040 for enhanced accuracy of time and date records.

Microcontroller 1010 is coupled with a photocell 1020 and an RF transceiver IC 1030, which perform the function of environmental sensor 110 and compact interface 160 of FIG. 1, respectively. Microcontroller 1010 performs the functions of decoder 180, arming unit 120, reporting unit 130, real-time clock 170, information storage unit 140, and retrieval unit 150, all shown in FIG. 1. Battery 199 provides a self-contained power source to power microcontroller 1010 and RF transceiver IC 1030, and other active circuitry as required.

A suitable device for RF transceiver 1030 is the DTR-900 miniature Data Transceiver manufactured by the Radio Design Group Inc. This device has a serial input and output that allow a simple connection with I/O pins of microcontroller 1010.

Photocell 1020 is biased to trigger a digital input of microcontroller 1010 at a particular light intensity as determined by the requirements of the end user. Alternatively, microcontroller 1010 may receive a signal from photocell 1020 through an internal A/D converter. This allows more sophisticated detection of unwanted disposition by responding to a time-related increase in signal level from photocell 1020. In addition, glitch filtering can be done with a simple digital filtering operation on the signal received by such an A/D converter.

While the invention has been described in terms of several embodiments, those of skill in the art will understand that many combinations and permutations may be devised without departing in any way from the invention. For example, there are many combinations of environmental sensing devices and compact interface formats that will be apparent to one of skill in the art upon reading of the specification and drawing. Although environmental sensing devices have been described for detection of such conditions as increased light from opening of an enclosure, excessive or off-axis acceleration from dropping or tilting of a package, and temperature outside specific thermal limits, one of skill in the art will readily appreciate that the invention provides for the detection of other environmental conditions for determining if a particular type of unwanted disposition has occurred. Similarly, one of skill in the art will easily be able to devise numerous different types of compact interface formats including, for example, PSK-modulated digital radio, a sequence of light flashes from an LED, or audible tones to preserve compactness without deviating in any way from the invention. Accordingly, it is to be understood that all such combinations and permutations fall within the scope of the present invention, which is defined by the appended claims.

I claim:

1. A self-contained, compact device for placing in an enclosure and detecting unwanted disposition of the contents thereof, comprising:

a) an environmental sensor responsive to an environmental condition indicative of unwanted disposition for generating a signal indicative of unwanted disposition;

b) a reporting unit enabled by the arming signal and responsive to the signal from the environmental sensor for providing information about the unwanted disposition;

c) an information storage unit responsive to information from the reporting unit for storing a record of the unwanted disposition;

d) a compact interface unit for communicating the record of the unwanted disposition in a compact format; and e) a compact surrounding shell of packaging material for presenting the appearance of a unit of ordinary packaging material.

2. The device of claim 1 wherein the information about the unwanted disposition includes information about magnitude of environmental stress and duration of its occurrence.

3. A device for placing in an enclosure and detecting unwanted disposition of the contents thereof, comprising:

a) an environmental sensor responsive to an environmental condition indicative of unwanted disposition for generating a signal indicative of unwanted disposition;

b) a reporting unit enabled by the arming signal and responsive to the signal from the environmental sensor for providing information about the unwanted disposition;

c) an information storage unit responsive to information from the reporting unit for storing a record of the unwanted disposition;

e) a compact interface unit for communicating the record of the unwanted disposition in a compact format; and d) a decoder coupled to the environmental sensor and coupled to the arming unit, configured to accept the arming command in the form of a time-related pattern of user modification of the environmental condition.

4. The device of claim 3 further comprising a real-time clock for providing time information to the information storage unit, wherein the record of unwanted disposition is marked with time information related to its occurrence.

5. The device of claim 3 wherein the environmental sensor is responsive to light and is configured to generate a signal indicative of additional light caused by opening of an enclosure.

6. The device of claim 3 further comprising a surrounding shell of packaging material for presenting the appearance of a unit of ordinary packaging material.

7. The device of claim 3 wherein the information about the unwanted disposition includes information about magnitude of environmental stress and duration of its occurrence.

8. A device for placing in an enclosure and detecting unwanted disposition of the contents thereof, comprising:

a) an environmental sensor responsive to an environmental condition indicative of unwanted disposition for generating a signal indicative of unwanted disposition;

b) a reporting unit enabled by the arming signal and responsive to the signal from the environmental sensor for providing information about the unwanted disposition;

c) an information storage unit responsive to information from the reporting unit for storing a record of the unwanted disposition;

e) a compact interface unit for communicating the record of the unwanted disposition in a compact format;

f) a retrieval unit responsive to an interrogation command from a user and selectively enabling the compact interface unit, for selecting the record to be communicated in response to the interrogation command; and g) a decoder coupled to the environmental sensor and coupled to the retrieval unit, configured to accept the interrogation command in the form of a time-related pattern of user modification of the environmental condition.

9. The device of claim 8 further comprising a real-time clock for providing time information to the information storage unit, wherein the record of unwanted disposition is marked with time information related to its occurrence.

10. The device of claim 8 wherein the environmental sensor is responsive to light and is configured to generate a signal indicative of additional light caused by opening of an enclosure.

11. The device of claim 8 further comprising a surrounding shell of packaging material for presenting the appearance of a unit of ordinary packaging material.

12. The device of claim 8 wherein the information about the unwanted disposition includes information about magnitude of environmental stress and duration of its occurrence.

13. A method of detecting unwanted disposition of the contents of an enclosure, comprising the steps of:

a) providing a sensing device;

b) arming the sensing device by modifying the environmental condition perceived by the environmental sensor in a time-related pattern, the arming device being armed thereby to detect an environmental condition indicative of unwanted disposition;

c) placing the sensing device in the enclosure;

d) storing information about unwanted disposition when such disposition is detected; and e) communicating the stored information in a compact interface format.

14. The method of claim 13 wherein information about unwanted disposition includes time information related to its occurrence.

15. The method of claim 13 further comprising the step of interrogating the sensing device to select the stored information to be communicated.

16. The method of claim 15 wherein the step of interrogating the sensing device comprises modifying the environmental condition perceived by the environmental sensor in a time-related pattern.

17. The method of claim 15 further comprising the step of transmitting a wireless command signal to the sensor device for arming or interrogating it.

18. The method of claim 13 wherein the environmental condition is additional light from opening of the enclosure.

19. The method of claim 13 wherein the environmental condition is at least one of temperature, acceleration, orientation, magnetic field, humidity, barometric pressure, and sound level.

20. The method of claim 13 wherein the sensor is embedded in a surrounding shell of packaging material to conceal it by presenting the appearance of a unit of ordinary packaging material.

21. A self-contained, compact device for placing inside an enclosure and detecting unwanted disposition of the contents thereof, comprising:

a) an environmental sensor responsive to an environmental condition indicative of unwanted disposition and configured to i. accept user command in the form of a time-related pattern of user modification of the environmental condition, and ii. generate a trigger signal when the environmental condition indicates that unwanted disposition has occurred;

b) an arming unit responsive to an arming command from the compact user interface for generating an arming signal upon assertion of the arming command;

c) a reporting unit enabled by the arming signal and responsive to the trigger signal for providing notification of unwanted disposition;

d) a real-time clock for providing time information;

e) an information storage unit responsive to time information from the real-time clock and notification from the reporting unit for storing a time-related record of the unwanted disposition;

f) a retrieval unit responsive to an encoded interrogation command from the compact user interface and accessible to the record from the information storage unit, for communicating the record of the unwanted disposition in a compact interface format;

g) a decoder responsive to user command through the environmental sensor and coupled to at least one of i. the arming unit, the user command comprising the arming command, and ii. the retrieval unit, the user command comprising the interrogation command, wherein the user command takes the form of a time-related pattern of user modification of the environmental condition; and h) a surrounding shell of packaging material for presenting the appearance of a unit of ordinary packaging material.

22. A device for detecting unwanted disposition, comprising:

a) a light sensor for detecting light;

b) an arming unit responsive to an arming command from a user for generating an arming signal upon assertion of the arming command;

c) a reporting unit enabled by the arming signal and coupled to the light sensor for providing information about the detected light;

d) an information storage unit responsive to information from the reporting unit for storing a record of the information;

e) a compact interface unit for communicating the record in a compact format; and f) a surrounding shell of packaging material for presenting the appearance of a unit of ordinary packaging material.

23. The device of claim 22 further comprising a real-time clock for providing time information to the information storage unit, wherein the record of unwanted disposition is marked with time information related to its occurrence.

24. The device of claim 22 wherein:

a) the light sensor provides indicia of an amount of light sensed; and b) the reporting unit is responsive to the indicia to recognize a time-related increase in the indicia so as to detect opening of a surrounding enclosure.

* * * * *